United States Patent [19]

Bacon et al.

[11] Patent Number: 4,597,845

[45] Date of Patent: Jul. 1, 1986

[54] CONTINUOUS CONTACT PLATING APPARATUS

[75] Inventors: Jeffery E. Bacon, Long Beach; James E. Craig, South Pasadena; Mark K. Pedersen, Yorba Linda, all of Calif.

[73] Assignee: Robbins & Craig Welding & Mfg. Co., South El Monte, Calif.

[21] Appl. No.: 782,120

[22] Filed: Sep. 30, 1985

Related U.S. Application Data

[63] Continuation-in-part of Ser. No. 654,760, Sep. 25, 1984, abandoned.

[51] Int. Cl.[4] ..... C25D 17/00; C25D 17/14

[52] U.S. Cl. ..... 204/206; 204/224 R

[58] Field of Search ..... 204/206, 1, 211, 224 R

[56] References Cited

U.S. PATENT DOCUMENTS

| | | | |
|---|---|---|---|
| 2,591,042 | 4/1952 | Berman | 204/202 |
| 3,661,752 | 5/1972 | Capper | 204/206 |
| 3,951,772 | 4/1976 | Bick | 204/198 |
| 4,064,019 | 12/1977 | Eidschun | 204/224 R |
| 4,452,684 | 6/1984 | Palnik | 204/206 |

*Primary Examiner*—T. M. Tufariello

*Attorney, Agent, or Firm*—Price, Gess & Ubell

[57] ABSTRACT

A contact plater apparatus and method for plating selected areas of a web workpiece wherein the web workpiece and anode are in close proximity, separated only by the brush belt that contacts the web workpiece. A box manifold continually replenished with plating solution, provides the brush belt with plating solution from openings in a header as the solution passes over an anode. The brush belt of open-cell foam or other absorbent material wicks up the plating solution and brushes it on the desired spot on the cathodic web workpiece. The brush belt is guided past the box manifold in an accurately defined path. The web workpiece and brush belt are brought into precise contact at the openings in the header of the box manifold where the plating takes place. The guide for the web workpiece is adjustable along more than one axis to provide for contacting the brush belt with the web workpiece with a range of contact pressure and angles. Each guide is custom built for the parts to be plated.

17 Claims, 9 Drawing Figures

CONTINUOUS CONTACT PLATING APPARATUS

CROSS-REFERENCE TO RELATED APPLICATION

This application is a continuation-in-part of application Ser. No. 654,760, filed Sept. 25, 1984 now abandoned, for Continuous Contact Plating Method and Apparatus.

BACKGROUND OF THE INVENTION

1. Field of the Invention

The present invention relates generally to improvements in plating apparatus, and more particularly pertains to new and improved zone plating apparatus wherein precious metals such as gold, silver or palladium are plated on electrical contact areas on electrical components.

2. Brief Description of the Prior Art

Those concerned with the development of plating apparatus for plating precious metals such as gold and silver or palladium onto electrical components have long recognized the need for efficiency in the application of the precious metal to the workpiece, both in terms of control over the defined area that is plated and the thickness of the plating material. U.S. Pat. No. 4,064,019 for a continuous contact plater method issued Dec. 20, 1977 describes a system which is directed towards this end. However, the system falls short in several respects. It fails to accurately control the thickness of the precious metal being deposited on the selected area of the electrical components. It fails to plate an accurately defined area. It can only plate one zone on a component at a time. It is designed to plate curved surfaces. The present invention overcomes the shortcomings of the apparatus in U.S. Pat. No. 4,064,019 and all the prior art in this field. Specifically, the present invention can plate multiple zones, at one time, including front and back. It is also capable of plating flat or curved surfaces on a component.

SUMMARY OF THE INVENTION

The present selective contact plater apparatus provides the minimum necessary amount of plating solution to the web workpiece and plates at minimum thickness on curved or flat surfaces, multiple zones at one time, by keeping the anode very close to the web workpiece and utilizing a continuous brush belt that only touches the web workpiece with the electrified plating solution at the desired zone. The belt is constructed using materials and methods that make it structurally stable and impervious to the plating solution and also only apply a minimum amount of plating solution to the web. The belt moves against and across the web workpiece at a rate of speed that facilitates efficient plating. The guide for the web workpiece is guided along a precisely controlled path. The guide for the web workpiece is adjustable along more than one axis to provide for contacting the brush belt with the web workpiece with a range of contact pressure end angles.

BRIEF DESCRIPTION OF THE DRAWINGS

The objects and many of the attendant advantages of this invention will be readily appreciated as the same becomes better understood by reference to the following detailed description when considered in conjunction with the accompanying drawings in which like references numerals designate like parts throughout the figures thereof, and wherein.

DESCRIPTION OF THE PREFERRED EMBODIMENT

Figure 1:
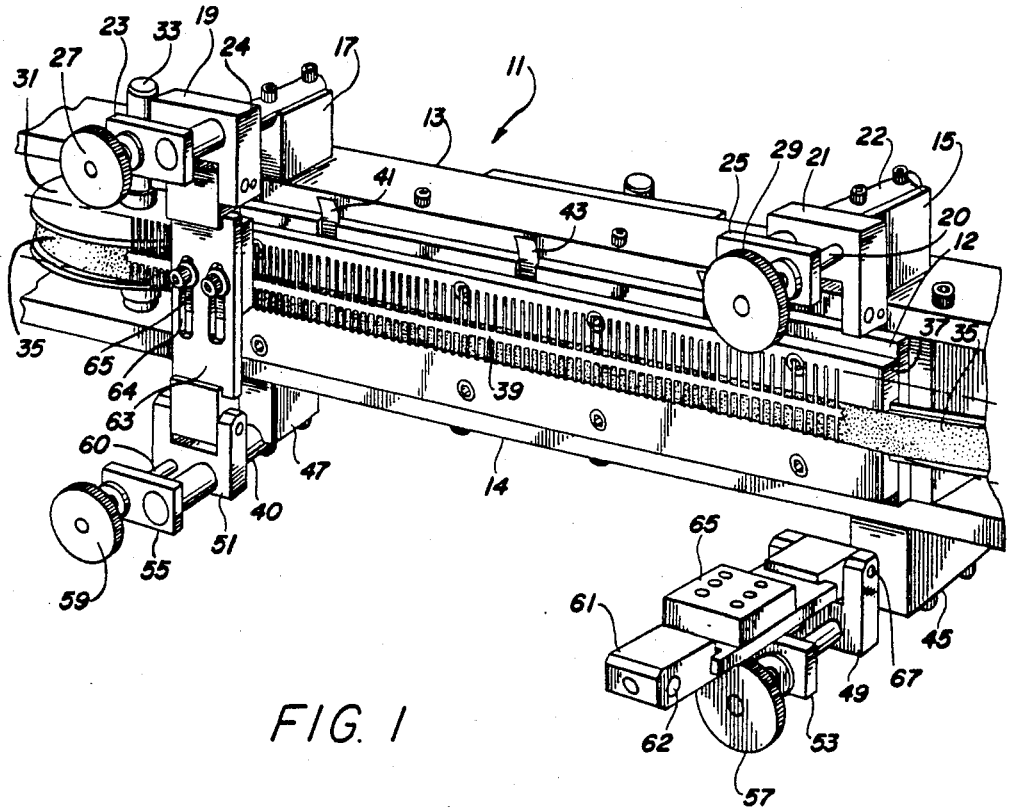
FIG. 1 is a perspective illustration of the continuous contact plating apparatus of the present invention.

Referring first to FIG. 1, which illustrates the major features of the continuous contact plating apparatus 11 according to the present invention, a web workpiece 39 is shown coming into contact with the brush belt 35 which effectively plates selective portions of the continuous web workpiece 39. The web workpiece 39 is essentially a continuous web or a strip containing many pieces of electrical components which are to be selectively plated with a precious metal electrical conductor such as gold, palladium or silver, for example. The web workpiece 39, as is understood in the art, is charged cathodically. The manner in which this is accomplished is not shown. Neither are the takeup and supply reels which cause the web workpiece 39 to move past the contained supply of plating solution 12 and the brush belt 35.

Figure 7:
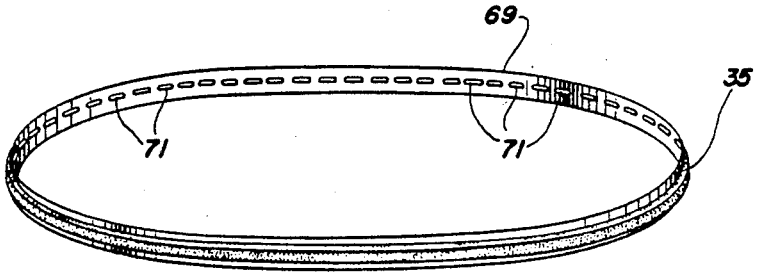
FIG. 7 is a perspective of the brush belt utilized by the continuous contact plating apparatus of the present invention.

The brush belt 35, as is more clearly seen in FIG. 7, is a continuous loop having a backing 69 that is structurally stable and chemically inert to the plating solution utilized. A material such as titanium is preferred. This backing has a plurality of apertures 71 punched therein along its length to allow plating solution fluid to pass therethrough to the brush portion 35, which is a highly absorbent material and chemically inert to the plating solution. An open cell urethane foam or other materials such as felt or neoprene is preferred. The absorbent material must be capable of allowing the solution to pass through from one side to the other and be held by the material.

The brush belt 35 moves over a series of pulleys, only one of which is shown, 31. Pulley 31 can be considered the driving pulley that moves the belt past the face or header 12 of the contained supply of plating solution. Pulley 31 is rotated by driving its rotary shaft 33.

The contained supply of plating solution and its header 12, as well as the guide 37 for the brush belt 35 which is fastened thereto, is contained within a framework which has an upper shelf and a lower shelf 14. The upper shelf 13 carries support structures 15 and 17 which in turn support latching blocks 21 and 19, respectively. Latching blocks 21 and 19 are moved back and forth on their respective shafts by way of knobs 29 and 27, respectively. Knob 29, for example, drives the threaded shaft 20 which threadably engages latching block 21, causing it to move back and forth on carrier shaft 22.

A similar type of adjustable mechanism is utilized at the bottom plate 14 for the plater apparatus. Support blocks 45 and 47 support hinge blocks 49 and 51, respectively, by way of circular shafts such as 40, for example. The knob-screw apparatus 57 and 59, respectively, turn within screw support plates 53 and 55, respectively, to rotate bolt 60, for example, which threadably engages pivotal block 51, causing it to ride back and forth on support shaft 40.

To ensure that the web workpiece 39 makes correct contact with the brush belt 35 moving within the pathway 37, a contact arm such as 63, which is pivotally connected to pivot block 51, is swung up and engaged with latching block 19 by way of a dowel pin 24, for example, which slides through the latching block 19 into its respective connecting head. The workings of the contact arm are more clearly illustrated when unlatched on the right-hand side of FIG. 1, wherein the contact block 65 is clearly illustrated. The connecting head 61 has an aperture 62 therein for receiving the connecting pin. The contact block 65 can be positioned on the arm 63 by way of moving the block in the slots 64 therein by loosening the thumbscrews 65. Once disconnected from connecting block 21, the entire contact arm may be pivoted down around pivot hinge 67.

Figure 2:
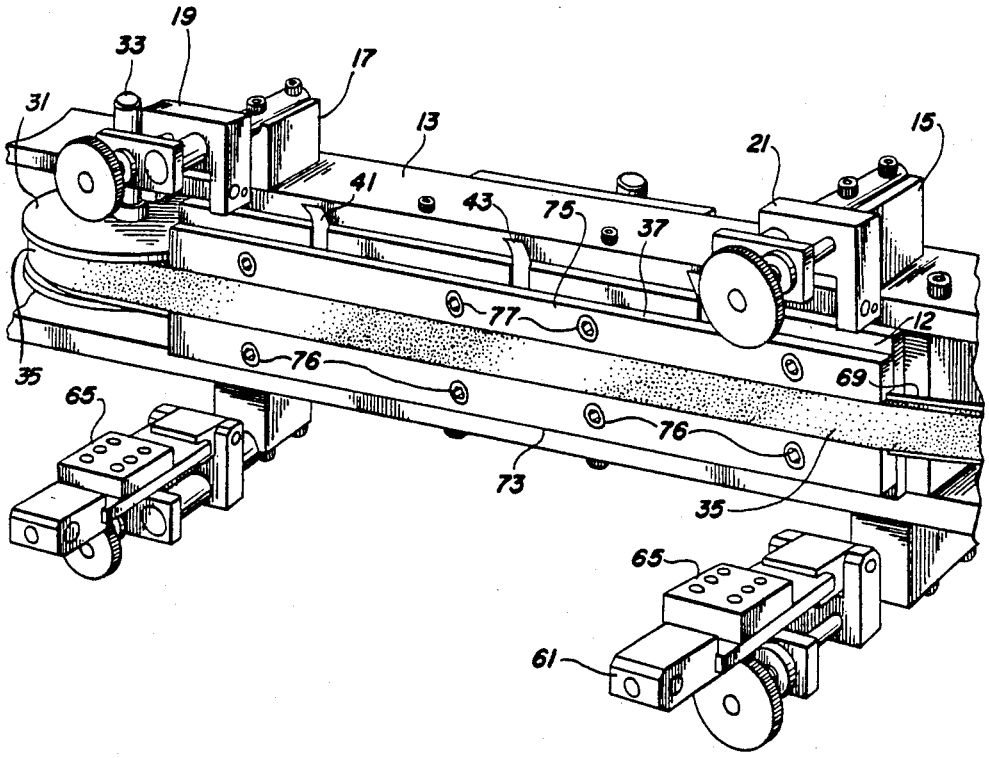
FIG. 2 is a partial perspective illustration of a continuous plating apparatus showing the brush belt.

Referring now to FIG. 2, the guide means 37 for the brush belt 35 is more clearly illustrated. The brush belt guide 37 has a pair of major parts, upper fastening bar 75 and lower fastening bar 73, which fasten to the front of the contained supply of plating solution 12 by way of countersunk bolts 77 in the upper bar 75 and bolts 76 in the lower bar 75. Both the upper and lower bar 75 and 73, respectively, overlay the edges 69 of the brush belt 35, thereby guiding it across the face of the contained supply plating solution 12 in both a horizontal and vertical direction.

Located behind the guide 37 is the anode which has electrical connector arms 41 and 43 shown in FIG. 2 to which electrical connection is made.

Figure 3:
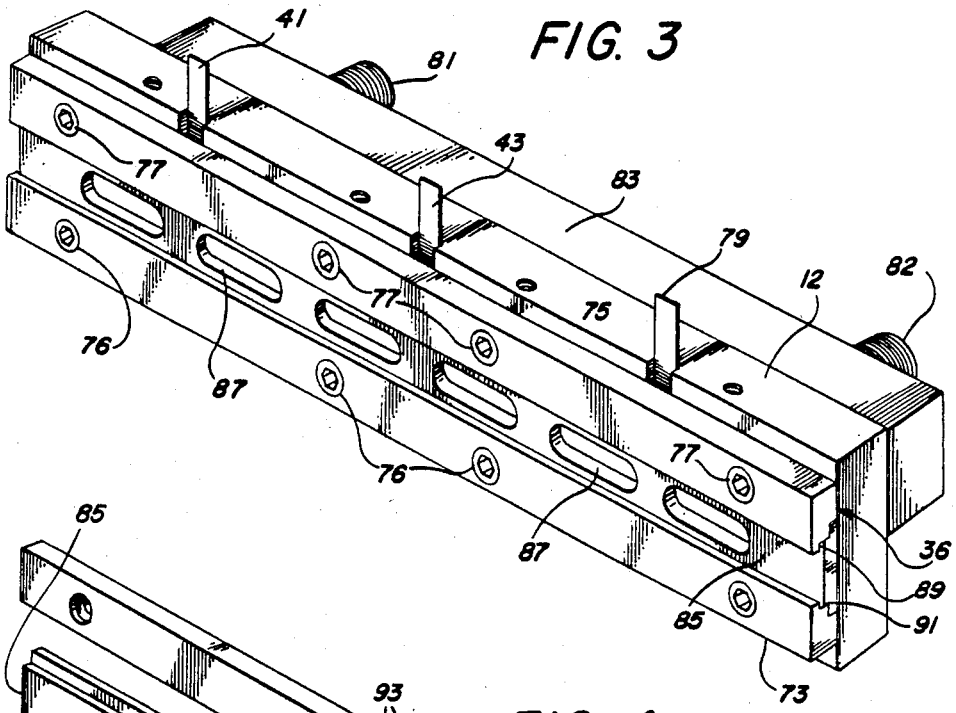
FIG. 3 is a perspective of the continuous contact plating apparatus showing the guide device of the brush belt attached to the plating fluid chamber.

Referring now to FIG. 3, the contained supply of plating solution 12 is more clearly illustrated, as is the brush belt guide 36. The contained supply of plating solution 12 is essentially a box manifold 83 which has an inlet port 81 and an outlet port 82 through which plating solution flows. The plating solution can escape from the box manifold 83 and pass through the apertures 87 in slide bar 85, which is part of the brush belt guide 36. Apertures 87 are shown as formed to match the apertures in the titanium backing for the brush belt. However, such an arrangement should not be taken as limiting. Again, the electrical connector tabs 41, 43 and 79 for the anode located within the avenue of escape for the plating solution from the box manifold 83 are shown.

Figure 4:
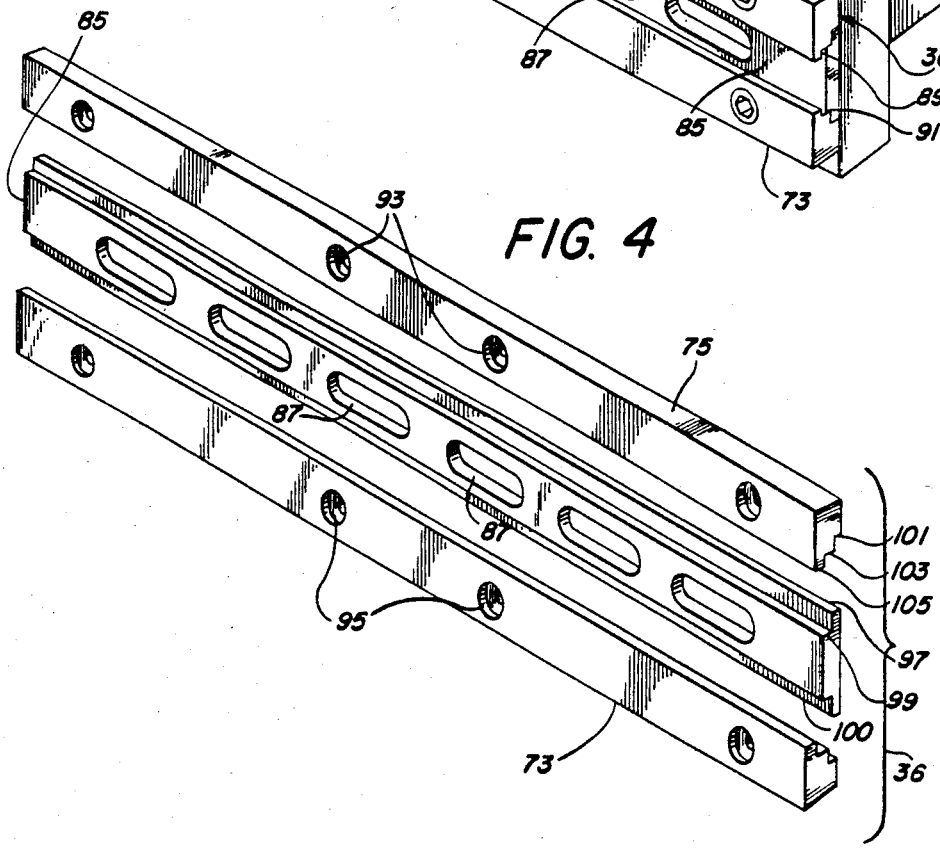
FIG. 4 is an exploded perspective showing the three main parts of the guide for the brush belt.

Referring now to FIG. 4, the major parts of the brush belt guide mechanism 36 are most clearly illustrated. Essentially, the brush belt guide mechanism 36 is made up of three parts. The slide bar 85, as already discussed, has a plurality of apertures located therein and stepped edges having two steps 99 and 97 at both edges of approximately equal distance. This slide bar 85 is preferably made out of a high density and smooth material like TEFLON or TIVAR or material having similar characteristics. Slide bar 85 overlays the front of the box manifold 83 and covers the avenue of escape of the plating solution out of the box manifold 83. It is held fast to the front by means of the upper fastening bar 75 and the lower fastening bar 73. Both the upper bar 75 and lower bar 73 have a three-step edge, 101, 103 and 105, which overlays the two-step edge on the slide bar 85. However, the middle step 103 of the fastening bars is greater than the first step 99 of the slide bar so that a gap 89 and 91, respectively, slightly greater than the thickness of the titanium metal ribbon which backs the brush belt is created, allowing the brush belt to slide within the gap. Also, the distance between the first step 99 of the top edge and first step 100 of the bottom edge of slide bar 85 is slightly greater than the width of the brush belt titanium backing. The apertures 93 in the upper fastening bar 75 and the apertures 95 in the lower fastening bar 73 are countersunk apertures to receive the Allen head bolts 77 and 76, respectively.

Figure 5:
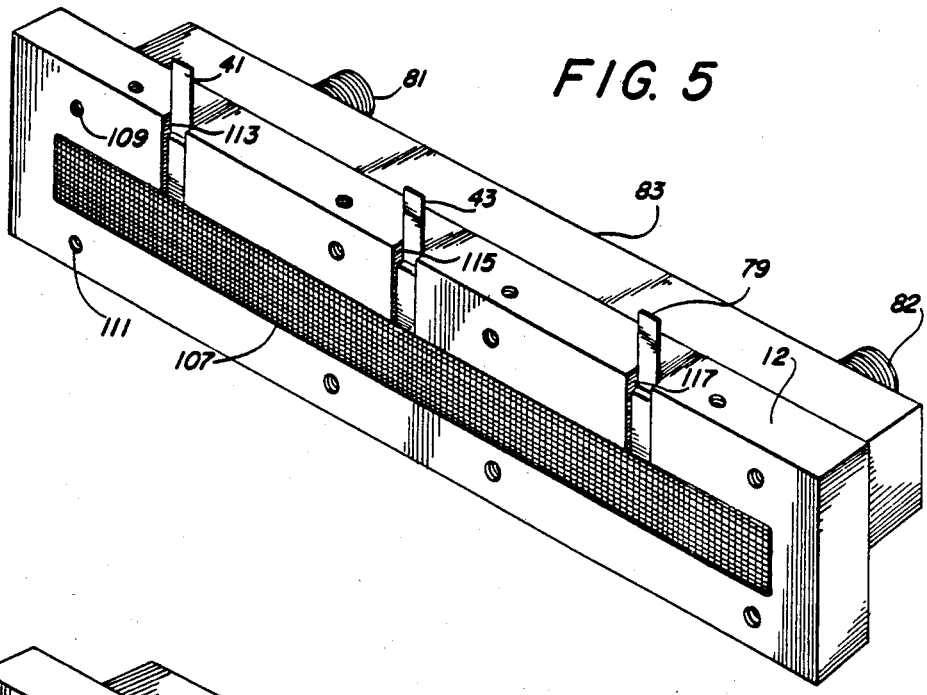
FIG. 5 is a perspective of a portion of the continuous contact plating apparatus according to the present invention showing the anode positioned with respect to the plating solution chamber.

Referring now to FIG. 5, the preferred anode structure to be used with the box manifold 83 is illustrated. The anode 107 is shown as a mesh or screen of platinum clad material, preferably platinum wire or other chemically inert material having similar characteristics, which has electrical connector tabs 41, 43 and 79 connected thereto and extending therefrom in channels 113, 115 and 117, respectively. The anode 107 lies within a recess 109 (FIG. 6) in the face of the box manifold 83, thereby providing a flat surface for the guide. Three pieces of the brush belt guide 36 to overlay the apertures 109 and 111 in the face of the box manifold 83 are threaded to receive the Allen head bolts that pass through the upper fastening bar 75 and lower fastening bar 73 of the brush belt guide apparatus 36.

Figure 6:
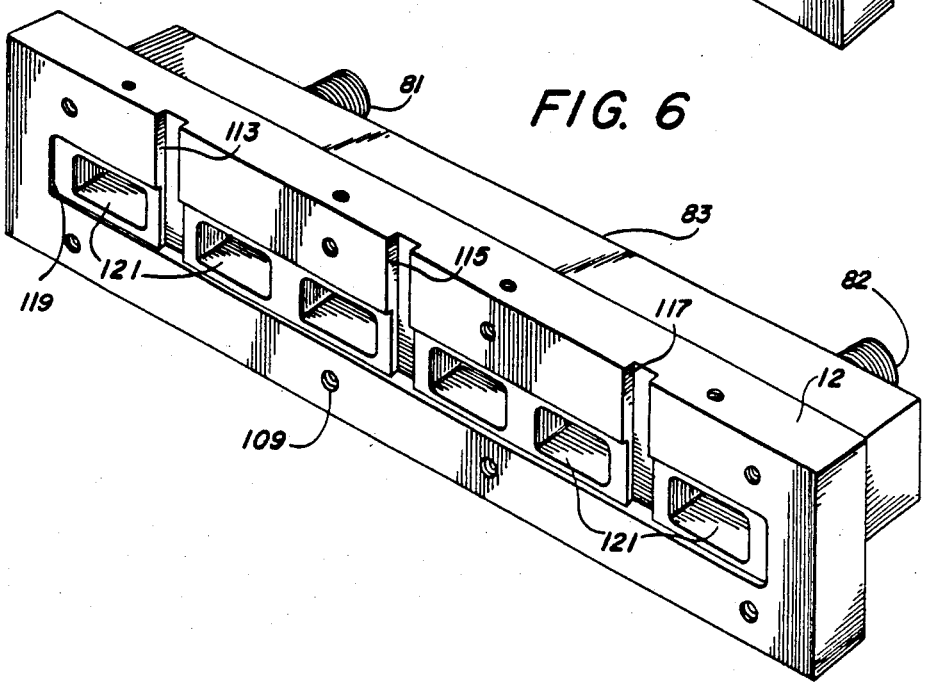
FIG. 6 is a perspective showing a portion of the continuous contact plater apparatus of the present invention, the anode chamber and the escape channels for the plating solution.

FIG. 6 more clearly illustrates the avenue of escape for the plating solution contained within the box manifold 83. The apertures 121 in the face of the box manifold are structured to correspond to the apertures 87 in the slide bar 85 of the brush belt guide apparatus 36. However, such an arrangement should not be considered as limiting, as other relationships may be found useful. The box manifold 83 is made of PVC material or some other material of equally inert characteristics to the plating solution.

The brush belt essentially has two major components, a loop of material which is a carrier for the loop of absorbent material which is the brush. The carrier is preferably a flat titanium ribbon of 10 mil thickness. It could also be made out of fiberglass plastic or similar material which has structural stability and is chemically inert to the plating solution utilized. Assuming the titanium ribbon is used as the carrier, it is formed into a loop by welding the two ends together. Then the apertures are placed therein approximately along a line that is at the center of its width, which apertures are of a desired length and width as may be, to some extent, dictated by the particular electrical components being plated.

An adhesive which can withstand the pH ranges and temperature ranges to which the brush belt will be subjected is utilized to glue the absorbent brush material to the carrier. The adhesive must be chemically inert to the plating solution utilized and must be compatible with the brush material that is being glued to the titanium loop.

A foam, felt, neoprene or similar material which will be the brush portion of the brush belt is formed to be of about equal width with the titanium loop and of equal length. It is preferred that an open cell urethane foam be utilized which has homogeneous pores and grain structure. It has been found that such a material exhibits excellent capillary action in drawing plating solution quickly from the contained supply in the box manifold to the surface that is to contact the electrical apparatus to be plated.

In operation, the belt is the carrier for the plating fluid in that it transmits the plating solution from the box manifold to the exact area on the part being plated, applying it by a brushing lateral movement across that area. The plating solution delivered by the brush belt is electrically charged. The belt is driven in a direction opposite to or with the web workpiece at a speed that will most effectively break down the cathodic film buildup on the interface or contact point between the brush belt and web workpiece.

Figure 8:
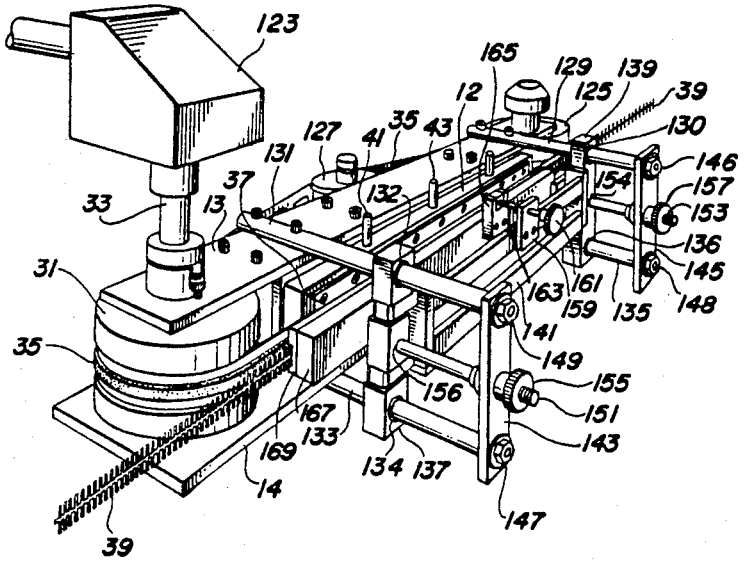
FIG. 8 is a side perspective of an alternate embodiment for the guide device for the web workpiece to be plated.
Figure 9:
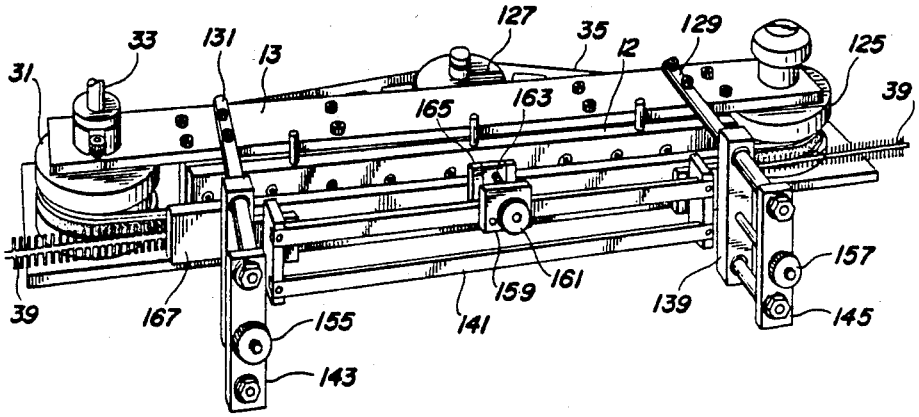
FIG. 9 is a front perspective of the guide device for the web workpiece shown in FIG. 8.

Referring now to FIG. 8, an alternate preferred embodiment for the structure that receives and guides the web workpiece 39 past and into contact with the brush belt 35 is illustrated. FIG. 9 illustrates the same embodiment from a different perspective. The apparatus illustrated in FIGS. 8 and 9 is designed to provide highly controlled placement of the web workpiece 39 with respect to the brush belt 35. This includes not only the amount of pressure with which the web workpiece 39 contacts the brush belt 35 but also the angle at which the web workpiece 39 engage the brush belt 35.

This control of the relationship between the web workpiece 39 and brush belt 35 is accomplished by the structure illustrated in FIGS. 8 and 9 which includes threaded control knobs 15, utilized for course adjustments, and control knob 161 used for fine adjustments, in moving the rigid backing plate 167 which holds the contoured guide 169 that is channeled to receive the specific construction of the parts in the web workpiece 39. It should be recalled that the brush belt 35 can also be custom contoured for a particular strip of parts.

FIGS. 8 and 9 illustrate the continuous contact plating apparatus built according to the present invention. The brush belt 35 moves over a series of pulleys 31, 125 and 127. Pulley 31 is the driving pulley which is connected by shaft 33 to a driving means 123. Driving pulley 31 moves the brush belt 35 past the header 12 which is contained within a framework having an upper shelf 13 and a lower shelf 14.

The upper shelf 13 carries a pair of shafts 131 and 129. The lower shelf 14 carries a pair of shafts 133 and 135 fastened by any convenient means, such is bolts. A block 137 having bearing surfaces 132 and 134 at opposite ends thereof is journalled on shafts 131 and 133, respectively, for the purpose of sliding along the length of shafts 131 and 133. Block 139 having a pair of bearing surfaces 130 and 136 is journalled on shafts 129 and 135, respectively, for the purpose of sliding back and forth on these shafts. Shafts 131 and 133 are held parallel by a plate 143 which receives the end of shafts 131 and 133 and fastens such ends to the plate by means of threaded bolts 139 and 147, respectively. In turn, shafts 129 and 135 are held parallel by plate 145 which receives the ends of shafts 129 and 135 and holds them fast by means of threaded bolts 146 and 148. Threaded shaft 151 is journalled through a plate 143 and engages block 137 rotatably but fixedly at about its center location 152. In this manner, movement of shaft 151 along an axis parallel to shafts 131 and 133 will cause movement of block 137 along these shafts in a smooth and easy manner as the result of the bearing surfaces 132 and 134.

At the other end of the rigid backing block 167 for the receiving and guiding device for the web workpiece 39 in association with the shafts 129 and 135, a threaded shaft 153 is rotatably but fixedly attached to block 139 at its center 154. Movement of shaft 153 along an axis parallel to shafts 129 and 135 will cause movement of block 139 along these shafts in a smooth manner because of bearing surfaces 130 and 136.

Movement of both blocks 139 and 137 along the respective shafts 129, 135 and 131, 133 is the result of turning threaded knob 155 which threadably engages shaft 151 and threaded knob 157 which threadably engages shaft 153. Turning knobs 155 and 157 in a clockwise direction will cause shafts 151 and 153, respectively, to be drawn outwardly, pulling blocks 137 and 139, respectively, with it. Turning threaded knob 155 and 157 in a counterclockwise direction, pushes shafts 151 and 153 inwardly towards the brush belt 35, pushing the blocks 137 and 139 with them.

Blocks 137 and 139 are connected together by a rigid block 141. Mounted on this block 141 is a plate 159 which has a threaded shaft 163 journalled therethrough and has fixedly mounted on its end a knurled knob 161. Threaded shaft 163 engages block 165 threadably causing block 165 to be moved up and down shaft 163 along its length upon rotation of knurled knob 161 in a clockwise or counterclockwise direction.

Block 165 is fixedly attached to a very rigid backing plate 167 to which is fastened the relatively friction free channeled guiding means 169 for the web workpiece 39. The channeled receiving and guiding device 169 is constructed very similar to the guiding construction 36 for the brush belt (FIGS. 3 and 4). A major difference would be the construction of the center piece 85 which would be shaped not with aperatures 86 therein, but in a manner to compliment the shape of the parts on the web workpiece 39. As a result, the web workpiece 39 is held to a very precise course of travel past the brush belt 35 which in turn is also held to a very precise course of travel past the header wherein it soaks up the charged plating solution needed to accomplish the plating function.

The mechanism shown in FIGS. 8 and 9 determines this precise course of travel of web workpiece 39. A manual adjustment of knobs 155 and 157 is a course adjustment that locates web workpiece 39 in proximity or minimal contact with brush belt 35. Movement of knobs 155 and 157 causes the shafts 151 and 153 to move, pulling with them block 137 and 139 which jointly pull with them block 141 to which is attached the fine adjustment mechanism having a plate 159 and 165 connected to block 141 and backing block 167, respectively. Movement of shafts 151 and 153 causes movement of rigid backing plate 167 in the same direction through threaded screw 163. Once the course adjustment of the backing plate 167 is established by knobs 155 and 157, the fine adjustment is accomplished by means of knurled knob 161 by turning it clockwise or counterclockwise causing movement towards and away from brush belt 35 in very fine or small increments.

Web workpiece 39 need not come into contact with brush belt 35 along an axis perpendicular to the brush belt 35 as illustrated in FIGS. 8 and 9. Rods 131, 133 and 129, 135 can, if desired, be adjusted to extend away from header 12 at any angle desired, depending upon the construction of the individual parts on the web workpiece 39, the contour of the brush belt 35, and the particular part of a web workpiece 39 upon which plating is desired. Changing the angle at which shafts 131, 133 and 129, 135 extend from the header 12 is easily accomplished once presented with the possibility of doing so. Accordingly, such a structure is not illustrated.

It should be understood that the foregoing disclosure relates only to the preferred embodiments of the invention and that modifications may be made therein without departing from the spirit and scope of the invention as set forth in the appended claims. For example, a squeegee apparatus may be placed at a location on the brush belt after it passes by the contained source of supply for the plating solution in order to squeeze out the plating solution remaining in the belt after the plating operation. In addition, plating solution may be added to the brush belt at a place other than from the box manifold and in addition to the solution provided to the belt by the box manifold.

Although the method and apparatus described is most advantageously usable with systems for plating gold, other materials and platable substances can be plated by the method and apparatus, such as silver, palladium, copper, nickel, tin or tin/lead, for example. Indeed, the system could also be used to selectively strip metal from a workpiece or apply lubricant thereto, or remove a fluid therefrom.

What is claimed is:

1. A selective contact plater for continuously plating a plurality of zones, comprising:

a contained supply of plating solution having an avenue of escape;

an anode mounted in close proximity to the avenue of escape for the plating solution so that all the plating solution leaving the supply passes over the anode;

a porous belt means mounted in close proximity to the avenue of escape for the plating solution for absorbing some of the plating solution after it has passed the anode;

means for moving said belt means past the avenue of escape for the plating solution;

means for moving a web workpiece to be selectively plated past said porous belt means; and means for receiving the web workpiece to be selectively plated, in the area of the avenue of escape for the plating solution, and guiding said web workpiece into contact with said belt means at those points on the web workpiece that are to be plated.

2. The selective contact plater of claim 1 further comprising a means for guiding said porous belt means past the anode and avenue of escape of the plating solution supply.

3. The selective contact plater of claim 2 wherein said porous belt guiding means also functions to direct the plating solution from the supply to the porous belt means.

4. The selective contact plater of claim 3 wherein said porous belt guiding means comprises a relatively friction-free material that is structurally stable and impervious to the pH and temperature ranges of the plating solution.

5. The selective contact plater of claim 4 wherein said porous belt guiding means comprises three main parts, the first part having aperatures therein that overlay overlap the avenue of escape for the plating solution and the anode, the second and third parts overlaying the edges of the first part and holding it fast to the contained supply of plating solution.

6. The selective contact plater of claim 5 wherein said second and third parts further overlay the edges of said porous belt means, thereby guiding the belt in a defined path over the first part.

7. The selective contact plater of claim 1 wherein said porous belt means comprises a continuous loop of material capable of absorbing plating solution.

8. The selective contact plater of claim 1 wherein said porous belt means comprises a continuous loop of material that is structurally stable and inert to the plating solution, said continuous loop of material having recesses therein to allow plating solution to pass therethrough, with absorbing material being mounted thereon over the recesses.

9. The selective contact plater of claim 8 wherein said continuous loop of structurally stable material comprises titanium and said absorbent material comprises an open-cell foam.

10. The selective contact plater of claim 8 wherein said open-cell foam is a polyurethane material having a uniform grain structure.

11. The selective contact plater of claim 10 wherein said open-cell foam material is held to said titanium belt by an adhesive capable of withstanding the pH and temperature ranges in the plating process.

12. The selective contact plater of claim 1 wherein said web workpiece receiving and guiding means comprises:

a rigid backing means extending the length of the avenue of escape of the plating solution; and a guiding means extending the length of the backing means for slidably receiving the web workpiece.

13. The selective contact plater of claim 12 wherein said web workpiece guiding means is channeled to receive the workpiece being plated.

14. The selective contact plater of claim 12 further comprising:

means attached to said receiving and guiding means for controllably moving the web workpiece received by said guiding means into contact with said porous material.

15. The selective contact plater of claim 14 wherein said controllably moving means includes:

a plurality of parallel shafts extending outwardly and away from said porous material;

a plurality of sliding bearings journalled, one each on said plurality of shafts;

a pair of first adjusting means, one at each end of said rigid backing means for moving the sliding bearings along the length of said shafts;

a second adjusting means attached to said bearings and to said rigid backing means for moving the backing means towards and away from said porous material in controlled small distances.

16. The selective contact plater of claim 15 wherein said plurality of parallel shafts extend outwardly and perpendicular to said porous material.

17. The selective contact plater of claim 12 wherein said web workpiece guiding means guides the web workpiece past said porous belt means at a preferred angle.

* * * * *